United States Patent [19]

Hnojewyj

[11] 4,058,641

[45] Nov. 15, 1977

[54] PAVEMENT MARKING METHOD

[75] Inventor: Olexander Hnojewyj, Columbia Heights, Minn.

[73] Assignee: Minnesota Mining and Manufacturing Company, St. Paul, Minn.

[21] Appl. No.: 702,336

[22] Filed: July 2, 1976

[51] Int. Cl.[2] ..... B05C 1/16; B05D 5/10

[52] U.S. Cl. ..... 427/137; 404/77; 427/202; 427/376 R; 427/422

[58] Field of Search ..... 427/137, 202, 376 R, 427/376 A, 407 R, 422, 299; 404/77, 75

[56] References Cited

U.S. PATENT DOCUMENTS

| | | | |
|---|---|---|---|
| 3,334,555 | 8/1967 | Nagin et al. | 404/75 |
| 3,393,615 | 7/1968 | Micheln | 427/423 |
| 3,410,185 | 11/1968 | Harrington | 404/77 |
| 3,664,242 | 5/1972 | Harrington et al. | 427/137 |
| 3,914,468 | 10/1975 | Condon et al. | 427/137 |

*Primary Examiner*—Ronald H. Smith
*Assistant Examiner*—Sadie L. Childs
*Attorney, Agent, or Firm*—Cruzan Alexander; Donald M. Sell; Roger R. Tamte

[57] ABSTRACT

Pavement markings of improved durability are obtained by first forming a bonding layer on the pavement surface with a liquid coating composition that comprises a polyamide condensation product of dimerized fatty acid and polyamine and then forming a top or marking layer over the bonding layer by applying through a flame solid particles of a marking material that comprises the same type of polyamide, preferably in a higher-molecular-weight version.

9 Claims, 1 Drawing Figure

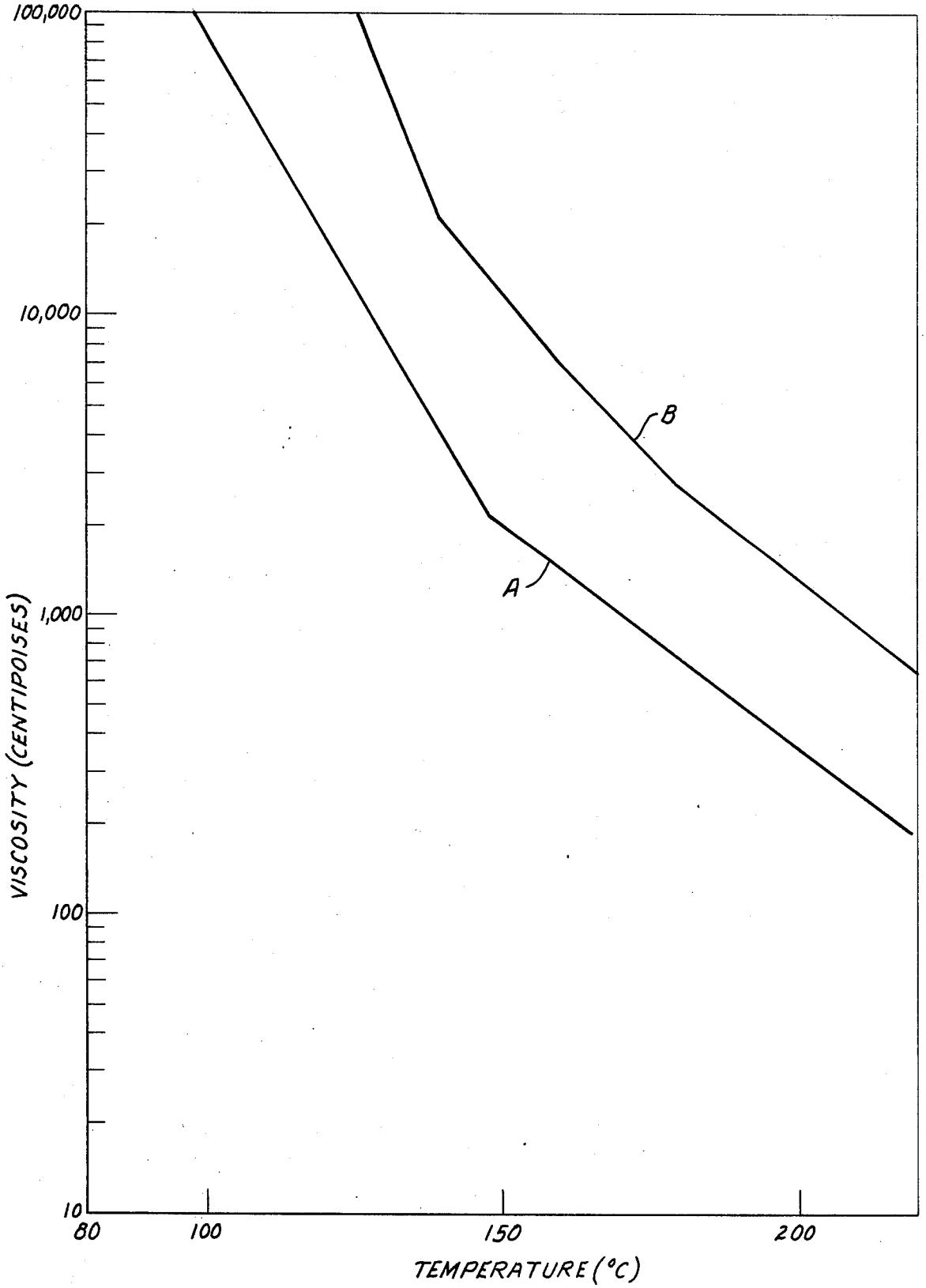
100,000
10,000
1,000
100
10
VISCOSITY (CENTIPOISES)
80
100
150
200
TEMPERATURE (°C)
A
B

PAVEMENT MARKING METHOD

BACKGROUND OF THE INVENTION

The present invention provides an improvement in pavement marking methods of the type taught in Harrington, U.S. Pat. No. 3,410,185; Harrington and Jorgensen, U.S. Pat. No. 3,664,242; and Condon and Harrington, U.S. Pat. No. 3,914,468. A basic part of these methods, as described in the first two listed patents, is the application of solid particulate thermosoftening marking materials to paved surfaces in the presence of heat to form continuous markings. Such methods made possible for the first time the formation of markings on paved surfaces that are ready to bear traffic within seconds after application.

Condon and Harrington obtained longer-lasting pavement markings by forming a bonding layer on the paved surface prior to application of the particulate thermo-softening marking material. The bonding layer was formed by coating onto the paved surface a thin bonding layer of low-viscosity film-forming bonding material which readily wets the paved surface, then advances to a non-spreading form, and ultimately advances to a tough film that adheres well to the paved surface.

The present invention provides a further increase in the life of pavement markings formed by the general procedure described. The invention is directed particularly to methods of pavement marking in which the marking material comprises solid particles that include a polyamide condensation product of dimerized fatty acid and polyamine. Briefly, the improvement comprises forming a bonding layer prior to application of the solid particles of marking material, the bonding layer being formed from a low-viscosity liquid coating composition that comprises 100 parts of a thermoplastic polyamide condensation product of a dimerized fatty acid and an amine, and at least 50 parts of volatile solvent in which the condensation product is dissolved; the solvent evaporating from the liquid coating composition at a rate of at least 0.20 gram/square centimeter/hour at a temperature of 24° C and a relative humidity of 50 percent. Preferably, the liquid coating composition also includes an adhesion-promoting organosilane, the organic moiety of which is preferably potentially reactive with reactive functional groups in the polyamide of the solid particulate marking material. Also, for best results, the polyamide of the liquid coating composition is a low-molecular-weight material, as indicated by a low melt-viscosity, such as less than about 1000 centipoises at 160° C.

Best results in the invention are also obtained when the polyamide of the solid particulate marking material, i.e., the topcoat material applied over the bonding layer, has a high molecular weight, as indicated by a high melt-viscosity, preferably 2000 centipoises or more, at 190° C. Such high-molecular-weight polymers are more tough and flexible, though their flow during application is inhibited by their high molecular weight. However, with bonding layers applied according to the present invention, marking materials containing such high-molecular-weight polyamides have been applied to obtain highly durable markings.

While the full explanation for the improved durability obtained by the invention is not known, it is theorized that the polyamide of the bonding layer and the polyamide of the particulate marking or topcoat material coated over the bonding layer become intermixed during the marking operation, and that this intermixing is a compatible one that promotes good bonding and long useful life. Further, the proposed reaction of the organic moiety with reactive functional groups, such as amine groups, carried on the polyamide further improves the bond between the bonding layer and top layer. In addition, the silane moiety of the adhesion-promoting agent is believed to provide increased adhesion to the substrate, particularly concrete substrates, which include hydroxyl groups. Such adhesion between the silane moiety and pavement may be improved by hydrolyzing of the silane to silanol groups, which can occur in the presence of moisture.

Whatever the explanation, significant increases in durability have been obtained. For example, some side-by-side tests of markings formed using bonding layers as taught in the Condon and Harrington patents with markings formed according to the present invention have shown two-fold and greater improvements in durability. Such improvements significantly increase the scope of utility for marking methods of the general type which use particulate thermosoftening marking materials applied through a flame.

DETAILED DESCRIPTION

Thermoplastic polyamide products of dimerized fatty acid and polyamines come in a variety of molecular-weight categories. Generally speaking, any of them are useful in bonding layers formed according to the invention, if dissolved to a low-viscosity condition. However, as previously noted, preferred results are obtained with low-molecular-weight or low-melt-viscosity versions. It is theorized that the application of heat during later application of the particulate marking or topcoat material more readily softens such low-melt-viscosity versions, causing them to better penetrate into the paved surface and further improving the intermixing between the polyamide of the bonding layer and the polyamide of the topcoat material.

The solvents used in the bonding material should evaporate or escape quickly from an applied line. Once the liquid coating composition has been applied to the paved roadway surface, it rapidly advances (preferably in less than 30 seconds) to a non-spreading (and preferably nontacky) form that is sufficiently free of flammable solvents so that, when briefly exposed to an elevated temperature between 150° and 500° F, or a flame, it will not char or burn. To achieve desirably fast drying, permitting quick application of the topcoat the solvents should evaporate at a rate of at least 0.02, and more preferably at a rate of at least 0.04, gram/square centimeter/hour from an applied bonding layer, at 24° C and 50 percent relative humidity. A particularly useful solvent with polyamides is ethanol; other useful solvents include blends of isopropanol/toluene and of n-propanol/toluene.

Sufficient solvent is used to provide a viscosity of less than 1000 centipoises; preferably less than 100 centipoises. In such a low-viscosity condition, the bonding layer forms a thin film, preferably less than about 3 mils, and more preferably less than about 1 mil, thick.

When organosilanes are included in liquid coating compositions from which bonding layers are prepared according to the invention, they are generally included in an amount of at least about one-half part by weight per 100 parts of polyamide. Preferably, they are included in an amount of at least 1 part, and more preferably at least about 10 parts, per 100 parts of polyamide. Generally no more than about 20 parts are included.

Particulate fillers in the bonding layer are of value in improving evaporation of solvent. But a very small amount will accomplish the needed improvement; as little as one part per 100 parts polyamide is effective, for example.

Flow-control agents, which improve the flow and wetting of the bonding layer, are also desirable. Useful flow-improving agents include distilled tall oils; blends of isooctylacrylate and ethyl acrylate; and triphenyl phosphate.

The bonding material is preferably not colored but is instead substantially clear, since any vehicle traffic over an applied bonding layer before it is dry will then not form tracks on the pavement adjacent to the marking.

A particularly useful marking or topcoat material to apply over the bonding layer of the invention includes, as previously noted, rather high-molecular-weight polyamides. While such materials are somewhat more difficult to melt to a low-viscosity state when applied as solid particles through a flame, they also provide better wear resistance and toughness when fused into a marking on the roadway. Thus, preferably at least 10, and more preferably at least 20, weight-percent of the polyamide ingredients in a top coat material used with bonding layers of the invention exhibit a melt-viscosity of at least 2000 centipoises at 190° C. Such polyamides include "Versalon" 1112, 1138, 1164, and 1300 and "Emerez" 1558. In general, polyamide ingredients comprise at least 50 weight-percent of the organic ingredients of the topcoat material (and organic ingredients comprise at least 25 volume-percent of the topcoat material).

For ideal results for a topcoat material, it is desirable for the organic phase ingredients to exhibit a viscosity-temperature profile as indicated for two representative useful organic phases in the FIGURE of the drawing, curve A being the most preferred.

Over the lower-temperature regions of the profile, the viscosity-temperature plot is rather steep, meaning that the organic phase will rapidly increase in viscosity with small reductions in temperature; i.e. will solidify rapidly. But over the range of higher temperatures, which the organic phase will experience during application, it is desirable for the organic phase to maintain a low viscosity. The low melt-viscosity in such temperature regions, as particularly represented by curve A, can be obtained by use of modifiers such as castor wax or candellia wax. Other ingredients that can be used to provide low viscosity at the stated temperatures include blends of isooctylacrylate and ethylacrylate.

Tackifiers or other modifiers having a narrow melting range and a steep temperature-viscosity profile are also desirable in the topcoat formulation. Useful tackifiers include terpene-modified phenolics, such as Super Beckacite 2000 and various hydrocarbon resins.

Desirably at least a portion of the polyamide in the topcoat formulation used over a bonding layer of the invention includes functional groups (e.g. amine and acid groups) which are capable of reacting with the organic, preferably epoxy, functionality of the silane.

The teachings of the previously noted Harrington, U.S. Pat. No. 3,410,185; Harrington et al., U.S. Pat. No. 3,664,242; and Condon et al., U.S. Pat. No. 3,914,468 are incorporated herein by reference. As taught in the first two patents the organic-based particles of the topcoat or marking material are generally capable of passing a screen of about 20 mesh, with at least about 80 weight-percent being retained on a screen of about 200 mesh. Preferably the particles pass a screen of 40 mesh, with at least about 80 weight-percent being retained on a screen of about 100 mesh. The particles should be non-tacky, nonblocking, free-flowing, and solid at normal ambient temperatures up to about 120° F. to permit them to be handled practicably in marking equipment. A coloring agent is generally included in the particles in an amount sufficient to color a marking formed from the marking material.

The organic phase of the particles should melt quickly to a low-viscosity condition such that the heated condition of the bonding layer and the particles will cause the particles to wet and bond to the surface of the bonding layer and coalesce into a film. But the organic phase should achieve a solid nontacky condition within seconds up to about 1 minute when cooled to about 75° F. (24° C). During application of the topcoat material the surface portion of the roadway and bonding layer are generally heated to a temperature between about 150° and 500° F. (66°–260° C) (as measured, for example, by heat-sensitive crayon marked on the roadway).

The topcoat or material preferably includes an inert nonmelting particulate material, such as transparent glass beads, in an amount of at least 1 volume-percent, and preferably in an amount of at least 10 or 15 volume-percent of the marking material. This inert particulate material generally is within the same size range as the organic-based particles.

The invention will be further illustrated by the following example. A bonding material was prepared by mixing the following ingredients:

| Ingredient | Parts by Weight |
|---|---|
| Polyamide condensation product of dimerized fatty acid and polyamine having a melt viscosity of 6.5–9.0 poises at 160° C (Versamid 750 supplied by General Mills) | 176.2 |
| Gamma-glycidoxypropyltrimethoxysilane (Union Carbide A-187) | 20 |
| Distilled tall oil (flow-control agent; Unitrol DT-30 | 2.5 |
| Silicon dioxide (Cab-O-Sil M-5) | 2.5 |
| Ethanol | 622.6 |
| Isopropanol | 91.6 |
| Toluene | 84.6 |

The evaporation rate of the above formulation was 0.0504 gram/square centimeter/hour at 24° C and 50 percent relative humidity. Other useful low-molecular-weight or low-melt-viscosity polyamides that could be used instead of or in addition to Versamid 750 are Versamid 712, Versamid 871, Uni-Rez 2207, or 2211.

A topcoat material was also prepared by blending the following ingredients at elevated temperature, then grinding the blend into particle form and screening between 40 and 100-mesh screens, and then adding 40- to 230-mesh glass microspheres in an amount constituting 33 weight-percent of the material.

| Ingredient | Parts by Weight |
|---|---|
| Polyamide condensation product of dimerized fatty acid and polyamine having a melt viscosity of 40–60 poises at 210° C (Versalon 1138 supplied by General Mills) | 116.2 |
| Polyamide condensation product of dimerized fatty acid and polyamine having a melt viscosity of 21.0–27.0 | |

-continued

| Ingredient | Parts by Weight |
|---|---|
| poises at 160° C (Versamid 930 supplied by General Mills) | 116.2 |
| Polyamide condensation product of dimerized fatty acid and polyamine having a melt viscosity of 26–34 poises at 160° C (Emerez 1533 supplied by Emery Industries, Inc.) | 232.7 |
| Terpene-modified phenolic (Super-Beckacite 2000 supplied by Reichhold Chemicals Inc.) | 25.0 |
| Rutile titanium dioxide (Ti-Pure R-960 supplied by DuPont) | 116.2 |
| Anatase titanium dioxide (Horsehead A-410 supplied by New Jersey Zinc Co.) | 116.2 |
| Magnisium silicate (Asbestine 325 supplied by International Talc Co., Inc.) | 260.3 |
| Hydrogenated castor oil (12-Hydroxy-stearin) (Castor Wax supplied by Baker Castor Oil Co.) | 9.3 |
| Candellia wax (supplied by J. W. Hanson Co.) | 7.0 |
| Gamma-glycidoxypropyltrimethoxysilane (Silane A-187 supplied by Union Carbide) | 0.9 |

Side-by-side test markings were then applied at several different experimental sites at a city in Louisiana (Location I in table below) and a city in Kentucky (Location II) using a marking material as described in Example 2 of U.S. Pat. No. 3,664,242 by itself (Sample A in the table below); using such a marking material applied as a topcoat over a bonding layer as generally described in Example 1 of U.S. Pat. No. 3,914,468 (Sample B); using such a marking material applied as a topcoat over a bonding layer of this example (Sample C); and using a topcoat material having the formulation set out above applied over a bonding layer of this example (Sample D). In forming the markings, the bonding material, if used, was first roller-coated onto the paved surface and then, after about one minute, the particulate topcoat material was applied through an applicator as described in U.S. Pat. No. 3,393,615, using the method generally described in U.S. Pat. Nos. 3,410,185 and 3,664,242. These markings, which were applied at each location to heavily-traveled concrete and asphalt city intersections, were observed at periodic intervals and rated by a number of independent observers for durability. The markings were given numerical ratings that represented the percentage of a line remaining (e.g. a rating of 5 meant 50 percent of a line was left). Ratings are given in the following table, which gives the number of lines of each sample applied at each location, the range of ratings for each sample, and the average of the ratings for each sample, after 3 and 6 months.

| | | Location I | | | | | Location II | | | |
|---|---|---|---|---|---|---|---|---|---|---|
| | | Condition of lines after | | | | | Condition of lines after | | | |
| | No. | 3 Months | | 6 Months | | No. | 3 Months | | 6 Months | |
| Sample | Lines | Ave. | Range | Ave. | Range | Lines | Ave. | Range | Ave. | Range |
| A | 2 | 1.7 | 1–3 | 0.8 | 0.5–1.0 | 2 | 6.4 | 6–7 | 3.6 | 3.5–4.0 |
| B | 8 | 6.4 | 3–9 | 5.3 | 1.5–8.0 | 6 | 6.8 | 6–8 | 4.8 | 2–6.5 |
| C | 3 | 5.8 | 5.5–6.5 | 5.0 | 4–6.0 | 2 | 8.2 | 7–9 | 7.3 | 6–8.5 |
| D | 10 | 8.9 | 6–9.5 | 8.5 | 4.5–9.5 | 6 | 8.7 | 8–9.5 | 8.6 | 7.5–9.5 |

What is claimed is:

1. In a method for making a paved roadway surface without first severely cleaning the surface comprising coating onto the surface a thin bonding layer of low-viscosity liquid coating composition which wets the paved surface and then rapidly advances to a nonspreading form, heating the paved surface and the bonding layer, projecting toward the heated layer a topcoat material that comprises a continuous stream of solid individual particles having an organic thermoplastic phase that comprises a polyamide condensation product of dimerized fatty acid and polyamine, and heating the particles so as to cause at least a major portion of the organic thermoplastic phase of the particles to soften before they reach the bonding layer; the improvement which comprises using as the liquid coating composition a material that has a room-temperature viscosity of less than about 1000 centipoises and comprises 100 parts of a thermoplastic polyamide condensation product of a dimerized fatty acid and an amine; and at least 50 parts of volatile solvent in which said condensation product is dissolved; the bonding layer formed by said liquid coating composition having an evaporation rate of at least 0.02 gram/square centimeter/hour at a temperature of 24° C and a relative humidity of 50%.

2. A method of claim 1 in which the liquid coating composition further includes at least 0.5 part of an adhesion-promoting organosilane.

3. A method of claim 2 in which said silane is an epoxy silane.

4. A method of claim 1 in which the liquid coating composition further includes at least one part of a solid particulate insoluble inorganic filler material.

5. A method of claim 1 in which the polyamide condensation product in the liquid coating composition has a melt-viscosity at 160° C of less than 1000 centipoises.

6. A method of claim 1 in which the bonding layer formed by said liquid coating composition has an evaporation rate of at least 0.04 gram/square centimeter/hour at 24° C and 50 percent humidity.

7. A method of claim 1 in which the organic thermoplastic phase of said solid particles includes polyamide condensation product having a viscosity at 190° C of 2000 centipoises or more.

8. In a method for marking a paved roadway surface without first severely cleaning the surface comprising coating onto the surface a thin bonding layer of low-viscosity liquid coating composition which wets the paved surface and then rapidly advances to a nonspreading form, heating the paved surface and the bonding layer, projecting toward the heated bonding layer a topcoat material that comprises a continuous stream of solid individual particles having an organic thermoplastic phase that comprises a polyamide condensation product of dimerized fatty acid and polyamine, and heating the particles so as to cause at least a major portion of the organic thermoplastic phase of the particles to soften before they reach the bonding layer; the improvement which comprises (1) using as the liquid coating composition a material that has a room-temperature viscosity of less than about 100 centipoises and comprises 100 parts of a thermoplastic polyamide condensation product of a dimerized fatty acid and an amine having a melt-viscosity of less than 1000 centipoises at 160° C; and at least 50 parts of volatile solvent in which said condensation product is dissolved, and which evaporates from said liquid coating composition at a rate of at least 0.04 gram/square centimeter/hour at a temperature of 24° C and a relative humidity of 50%; and (2) using a topcoat material that comprises a polyamide condensation product having a melt-viscosity at 190° C of at least 2000 centipoises.

9. A method of claim 8 in which the liquid coating composition further includes at least 0.5 part of an adhesion-promoting organosilane.

* * * * *